United States Patent [19]

Monico, Jr. et al.

[11] Patent Number: 4,736,857

[45] Date of Patent: Apr. 12, 1988

[54] TAMPER INDICATING CLOSURE

[75] Inventors: Michael A. Monico, Jr., West Chester, Pa.; Mark L. Kelly, Middletown, Conn.

[73] Assignee: American Home Products Corporation, New York, N.Y.

[21] Appl. No.: 931,281

[22] Filed: Nov. 14, 1986

[51] Int. Cl.[4] ..... B65D 55/02

[52] U.S. Cl. ..... 215/230

[58] Field of Search ..... 215/230; 340/687

[56] References Cited

U.S. PATENT DOCUMENTS

| | | | |
|---|---|---|---|
| 2,066,889 | 1/1937 | Kay | 215/19 |
| 2,414,420 | 1/1947 | Sebell | 215/43 |
| 2,821,951 | 2/1958 | Carver | 116/114 |
| 2,939,597 | 6/1960 | Greene | 215/7 |
| 3,396,482 | 8/1968 | Pradenas | 40/2.2 |
| 3,685,677 | 8/1972 | Westfall . | |
| 3,736,899 | 6/1973 | Manske | 116/70 |
| 3,794,200 | 2/1974 | Marks | 215/9 |
| 3,923,198 | 12/1975 | Brochman | 220/359 |
| 4,011,829 | 3/1977 | Wachsmann et al. | 116/121 |
| 4,150,371 | 4/1979 | Scaglione | 340/687 |
| 4,440,306 | 4/1984 | Van Buskirk et al. . | |
| 4,446,979 | 5/1984 | Gach et al. | 215/203 |
| 4,448,317 | 5/1984 | Thompson | 215/203 |
| 4,483,449 | 11/1984 | Jones . | |
| 4,489,841 | 12/1984 | Thompson . | |
| 4,500,005 | 2/1985 | Forrester . | |
| 4,502,605 | 3/1985 | Wloszczyna | 215/230 |
| 4,505,399 | 3/1985 | Weiner . | |
| 4,511,052 | 4/1985 | Klein et al. . | |
| 4,545,493 | 10/1985 | Shivers . | |
| 4,553,678 | 11/1985 | Thorsbakken | 215/218 |
| 4,571,691 | 2/1986 | Kennon | 340/545 |
| 4,579,240 | 4/1986 | Ou-Yang . | |
| 4,588,098 | 5/1986 | Uzdy | 215/230 |
| 4,588,465 | 5/1986 | Paciorek | 156/220 |

*Primary Examiner*—Stephen Marcus
*Assistant Examiner*—Nova Stucker
*Attorney, Agent, or Firm*—Edward M. Blocker

[57] ABSTRACT

A device for indicating whether a container having a cap has been opened. The device includes a switch or pressure transducer for detecting the engagement of the cap to the container and disengagement therefrom. A display, which is visible through the top of the cap, provides a plurality of messages which are in an irreversible and nonrepeatable sequence for indicating whether or not the cap has ever been removed from the container.

18 Claims, 5 Drawing Sheets

30
31
35
70
80
90
R
BP
P
O
A
+6V
101
102
103
104
105
106
107
108
109
110
111
F.F.
DECODER
CNTR
CLK
QA
QB
Q4
EN
MV
R1
R2
C1
C2
C3
R3
R4
SW1
T
61
32a
32b
71
72
81
91

TAMPER INDICATING CLOSURE

FIELD OF INVENTION

The present invention relates to the field of packages and containers whose contents are sealed therein by a closure and, more particularly, is directed toward a device for indicating whether or not the sealed package or container has been tampered with by displaying on the closure indicia as to whether or not the package or container has been previously opened.

BACKGROUND OF THE INVENTION

In recent years increased interest has focused on "tamper-resistant" packaging for various commodities and particularly those made for ingestion or topical application by humans.

A number of different approaches for producing a tamper resistant package have been suggested and/or implemented and include containers whose covers are essentially mechanically sealed through the use of a ratchet mechanism. This approach has been generally unsuccessful since reclosure of the container for subsequent use after the mechanical seal has been broken can be quite difficult. Another approach provides for a paper or foil inner seal glued around the edge of the container mouth. Unfortunately, such a seal can be opened and then resealed through the use of an adhesive. In yet another approach, a peripheral seal of plastic or the like is wrapped around both the cap and container. Peripheral seals, however, can be broken and then reglued. In still another approach chemical indicators, which change color upon exposure to the atmosphere, are disposed on the surface of the container between the container and its cover and are hemetically sealed from the atmosphere by a transparent material. Upon removing the cap, the seal is broken exposing the chemical indicator to the atmosphere. Thus the change in color of the chemical indicator signals whether the container has been opened. These chemical indicators, however, may falsely sense that the container has been opened if the transparent material becomes inadvertently dislodged from the chemical indicator prior to the cap having been removed from the container for the first time.

OBJECTS AND SUMMARY OF THE INVENTION

Consequently, it is an object of the present invention to provide a device which indicates whether the container or package has been tampered with and which avoids the above described prior art drawbacks.

More specifically, it is an object of the present invention to provide a new and improved device which indicates whether the closure for the container has ever been removed from the latter.

It is another object of the present invention to provide a tamper indicating device which is inexpensive and simple to manufacture.

It is yet another object of the present invention to provide a device which draws a user's attention to the tamper indicating indicia so as to alert the user as to whether the contents of the container is safe to use.

In accordance with one aspect of the invention, a tamper indicating closure for a container comprises a detecting circuit for sensing the engagement of the closure and container and disengagement thereof and for producing one of two different output signals based thereon; other electrical circuitry for processing the output signal produced by the detecting circuit; and display means such as but not limited to a liquid crystal display (LCD) which is responsive to the other electrical circuitry for indicating whether the closure has ever been removed from the container.

The invention has four different operating modes. Two of these operating modes, identified as the armed and opened modes, determine whether or not the closure has been tampered with. The other two operating modes, identified as the reset and prearmed modes, are helpful in determining whether the invention has been assembled correctly.

The above, and other objects features and advantages of the present invention will become apparent from the following detailed description which is to be read in conjunction with the accompanying drawings, wherein like reference numerals appearing in the various drawings refer to the same elements.

DETAILED DESCRIPTION OF PREFERRED EMBODIMENTS

Figure 1:
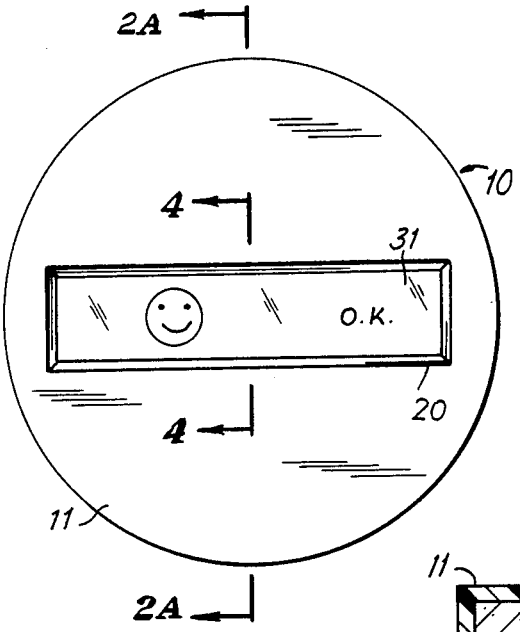
FIG. 1 is a top plan view of a cap.
Figure 2A:
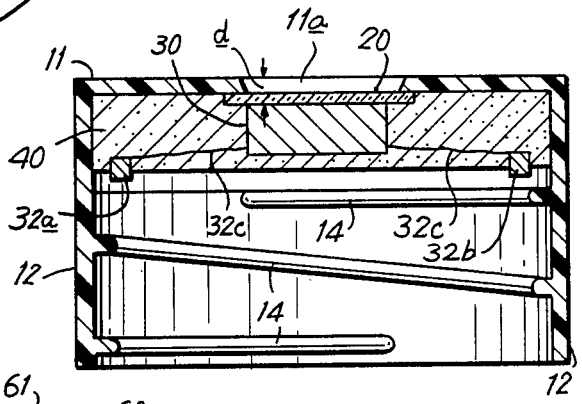
FIG. 2A is a cross sectional view of the cap taken along the lines 2A—2A in FIG. 1
Figure 2B:
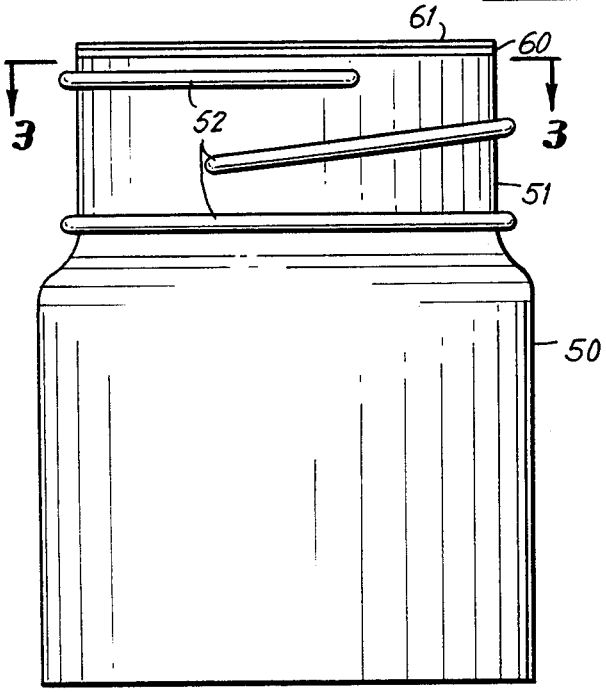
FIG. 2B is a front elevational view of a container.
Figure 3:
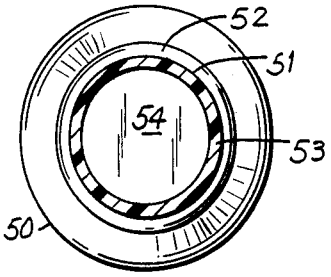
FIG. 3 is a cross sectional view of the container taken along the lines 3—3 in FIG. 2B.

Referring to FIGS. 1, 2 and 3, a cap, cover or other type of closure means 10 includes a ceiling 11, a peripheral wall 12, and a spiral thread 14 which circumferentially extends along the inner surface of wall 12. Ceiling 11 includes an opening **11*a* extending therethrough having a depth d. At the bottom of opening 11*a* is a translucent window 20 (e.g. made of Lexan, a trademark of the General Electric Company of Fairfield, Conn.) through which a display 31 can be viewed. Display 31 is part of a device 30 which will be described in detail below. Window 20 is held in place on the inner surface of ceiling 11 using a suitable adhesive material such as, but not limited to, epoxy. Cap 10 including ceiling 11, peripheral wall 12 and spiral thread 14 is typically made of plastic such as ABS plastic which can be obtained from the Dow Chemical Company of Midland, Mich. as Magnum 9020 ABS Resin. A suitable epoxy for securing window 20 to ceiling 11** also can be obtained from Dow Chemical Company and is identified as Q3-6567 Silicon Encapsulant.

A container 50 on which cap 10 can be screwed onto and screwed off of includes a neck 51 on whose outer surface a spiral thread 52 circumferentially extends. Container 50 is also typically made of plastic such as ABS plastic. Other means for securely fastening cap 10 to container 50 such as, but not limited to, a tongue and groove also can be employed. Neck 51 includes at its distal end a rim 53 which serves as the border for an opening 54 of container 50. In screwing cap 10 onto or off of container 50, threads 14 of cap 10 engage or disengage threads 52 of container 50, respectively.

Covering the opening 54 and rim 53 of container 50 is a conductive seal which may comprise a paper or other type of electrically nonconductive layer 60 laminated to a conductive foil 61. The layer 60 may be held in place on rim 53 by any suitable type of adhesive disposed therebetween such as, but not limited to, polyester glue. The foil or other type of electrically conductive layer 61 may be adhered to the nonconductive layer 60 by any suitable type of adhesive disposed therebetween. Alternatively, the electrically conductive layer 61 can be replaced by an electrically conductive material disposed on paper layer 60 to form an electrically conductive path between contacts 32*a* and 32*b* of cap 10 (described in further detail below) when cap 10 is fully screwed onto container 50. Typically, this path encircles opening 54 and is superimposed above rim 53. If desired, paper layer 60 need not be used and foil layer 61 may be bonded directly onto rim 53 or rim 53 may be coated or otherwise covered by an electrically conductive material. As will be appreciated hereinafter, a substantially zero impedence path exists between contacts 32*a* and 32*b*, which are located near walls 12, when cap 10 is fully screwed onto container 50.

Figure 4:
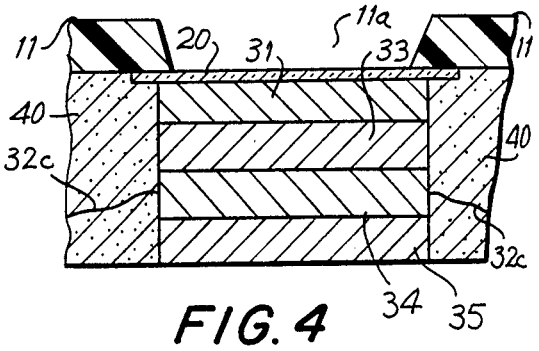
FIG. 4 is a cross sectional view of the cap taken along the lines 4—4 in FIG. 1.

Referring now to FIG. 4, the electronic circuitry of device 30 is divided into several physical parts comprising a printed circuit board (PCB)34, discrete components (such as resistors and capacitors) and integrated circuits (such as logic circuit 35). The discrete components and integrated circuits other than logic circuit 35 are represented within the rectangular cross section of PCB 34. The electronic circuitry is powered by a power source such as battery 33 to drive a liquid crystal display (LCD) 31. The sizes and shapes of LCD 31, battery 33, PCB 34, and logic circuit 35 have been shown as rectangular cross sections, sandwiched together, for explanatory purposes only, and need not be dimensionally limited as illustrated and described herein. LCD 31 abuts translucent window 20 so that the message displayed on the LCD is visible to a user.

The discrete components, integrated circuits, battery and LCD are either surface mounted to or physically mounted through PCB 34. PCBs are commercially available in various sizes. One such commercially available PCB is offered by Dynacircuits Inc. of Franklin Park, Ill. which has dimensions of one inch per side and which is identified as FR4 Rated Epoxy Glass. Surface mounting comprises connecting the discrete components, integrated circuits, battery, and LCD to solder pads which are located on either one or both sides of PCB 34. Physically mounting through a PCB comprises placing the legs of the discrete components, intergrated circuits, battery and LCD through openings within the PCB and soldering the appropriate legs together. Since device 30 as described herein uses off the shelf items including several silicon chips, for purposes of assembling device 30 in the least amount of space possible, these off the shelf items are connected to both sides of PCB 34. Of course, by customizing device 30 all of the integrated circuits and discrete components can be placed on one silicon chip. Therefore, by customizing device 30 all of the circuitry as well as and the LCD and battery can be connected to just one side of PCB 34.

Power source 33 is a 6 volt d.c. battery manufactured by the Panasonic Industrial Company, a division of Matsushita Electrical Corp. of America of Secaucus, N.J. and is identified as BR 112502HC. The battery has a capacity of approximately 38 milliampere hours although a customized battery should preferably have at least 200 milliampere hours to ensure that the battery has a lifetime of at least two years. The legs of battery 33 are sufficiently separated from each other such that an integrated circuit or discrete component can be placed between the battery and PCB 34. Although battery 33 is not relegated to any special area of PCB 34, in order to minimize space requirements using off shelf items described herein, battery 33 is connected to PCB 34 in the center of the latter.

As shown in FIG. 2A, most of device 30 including LCD 31, contacts 32*a* and 32*b*, electrically conductive wires 32*c* (which connect contacts 32*a* and 32*b* to PCB 34), battery 33, PCB 34, and all integrated circuits are securely held within and near ceiling 11 of cap 10 by a nonconductive, potting material 40 such as, but not limited to, epoxy. An acceptable epoxy is the Q3-6567 Silicon Encapsulant by Dow Chemical. Typically, after cap 10 has been molded and device 30 inserted within cap 10, the potting material is disposed within cap 10 so as to surround most of device 30 and then heat cured. Once cured, potting material 40 completely encapsulates device 30 except for portions of contacts 32*a* and 32*b* and seal 61. As viewed from within cap 10, potting material 40 (i) covers the entire inner surface of ceiling 11 and portions of the inner surfaces of walls 12, (ii) totally conceals and secures within cap 10 LCD 31, power source 31, wires 32*c*, PCB 34 and all integrated circuits including logic circuit 35 of device 30 (described in further detail below) and (iii) partially conceals and secures within cap 10 contacts 32*a* and 32*b* such that only the distal ends of contacts 32*a* and 32*b* protrude out of potting material 40. Accordingly, any attempt at gaining access to device 30 and especially LCD 31 for the purpose of tampering with the same will result in its partial or complete destruction. Additionally, such tampering would be visually obvious.

Based on the off the shelf components described heretofore, cap 10 is approximately $1\frac{1}{2}''$ in diameter and $1\frac{1}{4}''$ in height. Window 20 is approximately $1\frac{1}{8}''$ in length and $\frac{3}{8}''$ in width. The depth d of opening 11*a* is approximately 1/10" and the potting material 40 extends approximately 6/10" in height as measured from the inner surface of ceiling 11.

LCD 31 displays a plurality of different messages and/or symbols to indicate that (i) logic circuit 35 and other circuitry have been reset, (ii) device 30 is "prearmed", that is, that cap 10 has yet to be placed on container 50 for the first time, (iii) device 30 has been "armed", that is, when contacts 32*a* and 32*b* first form an electrical short circuit and (iv) cap 10 has been previously removed. For example as shown in FIG. 1, during the armed mode LCD 31 displays a combination of symbols (smiling face) and messages ("OK") which conveys to a user that container 50 has not been opened and that the contents can be safely used. As is well known in the art of LCD's, any symbol, number or other message which can be made on a silk screen is available for use in the present invention. Additionally and in order to draw attention to the fact that the contents of the container is safe to use, the symbols and/or messages on LCD 31 flash on and off during the armed mode. In this way, if a wrongdoer after tampering with cap 10 attempts to cover window 20 by, for example, pasting a smiling face over window 20 so as to mask the fact that container 50 has been tampered with, the absence of the smiling face and OK message flashing on and off will alert a user to the fact that container 50 has been previously opened.

Contacts 32*a* and 32*b* are electrically conductive, metallic materials which are polished so as to avoid scratching or tearing foil 61 as cap 10 is screwed onto container 50 for the first time. The smooth surfaces on the face of the contacts 32*a* and 32*b* ensure that as contacts 32*a* and 32*b* engage foil 61 an electrical short circuit between contacts 32*a* and 32*b* through foil 61 exists. As will be appreciated hereinafter, after cap 10 is removed from container 50 for the first time, it is irrelevant whether seal 61 becomes scratched, that is, whether an electrical short circuit ever again exits between contacts 32*a* and 32*b*.

In accordance with all of the preferred embodiments, device 30 has four separate operating modes referred to herein as reset, prearmed, armed and opened. These operating modes may be summarized as follows:

The reset mode, which lasts for approximately 68 milliseconds, occurs upon connecting a battery to the electrical circuitry. During the reset mode, at which time certain components within the circuitry are reset, the LCD will display the letter R on its face.

The prearmed mode occurs immediately after the reset mode and will continue until cap 10 is for the first time in contact with container 50 (for example, when cap 10 for the first time is fully screwed onto neck 51 of the container). During the prearmed mode, the LCD displays the letter P on its face. Display of the letters R (for reset) and P (for prearmed) on the face of the LCD is helpful during the manufacturing process to determine if device 30 has been assembled properly but is considered optional since neither denote whether the closure has been tampered with or not.

The armed mode begins immediately following the prearmed mode, that is, upon placing cap 10 on container 50 for the first time and ends upon container 50 being opened. LCD 31 will display a smiling face and the letters "OK" flashing on and off which indicate that cap 10 has been fully secured to container 50 but that cap 10 has never been removed from container 50. Accordingly, a user seeing the smiling face and letters "OK" flashing on and off knows that the contents within container 50 have not been tampered with.

The opened mode immediately follows the armed mode, that is, upon cap 10 being removed from container 50 for the first time. During the opened mode LCD 31 will display an unhappy face and the word "Tampered" which indicates that cap 10 has been removed from container 50 at least once. LCD 31 will remain in the opened mode thereafter whether or not cap 10 is secured to the container 50 again. Therefore, a user seeing the unhappy face and the word "Tampered" on the face of the LCD will immediately recognize that container 50 has been previously opened.

As previously noted, most if not all of the circuitry of the present invention is encapsulated within cap 10 to ensure that cap 10 cannot be tampered with without destroying these circuits. Furthermore, the circuitry is designed so that the four operating modes occur in an irreversible and nonrepeatable order. Consequently, LCD 31 will never revert back to the armed mode indication once it has indicated that it is in the opened mode.

Figure 5A:
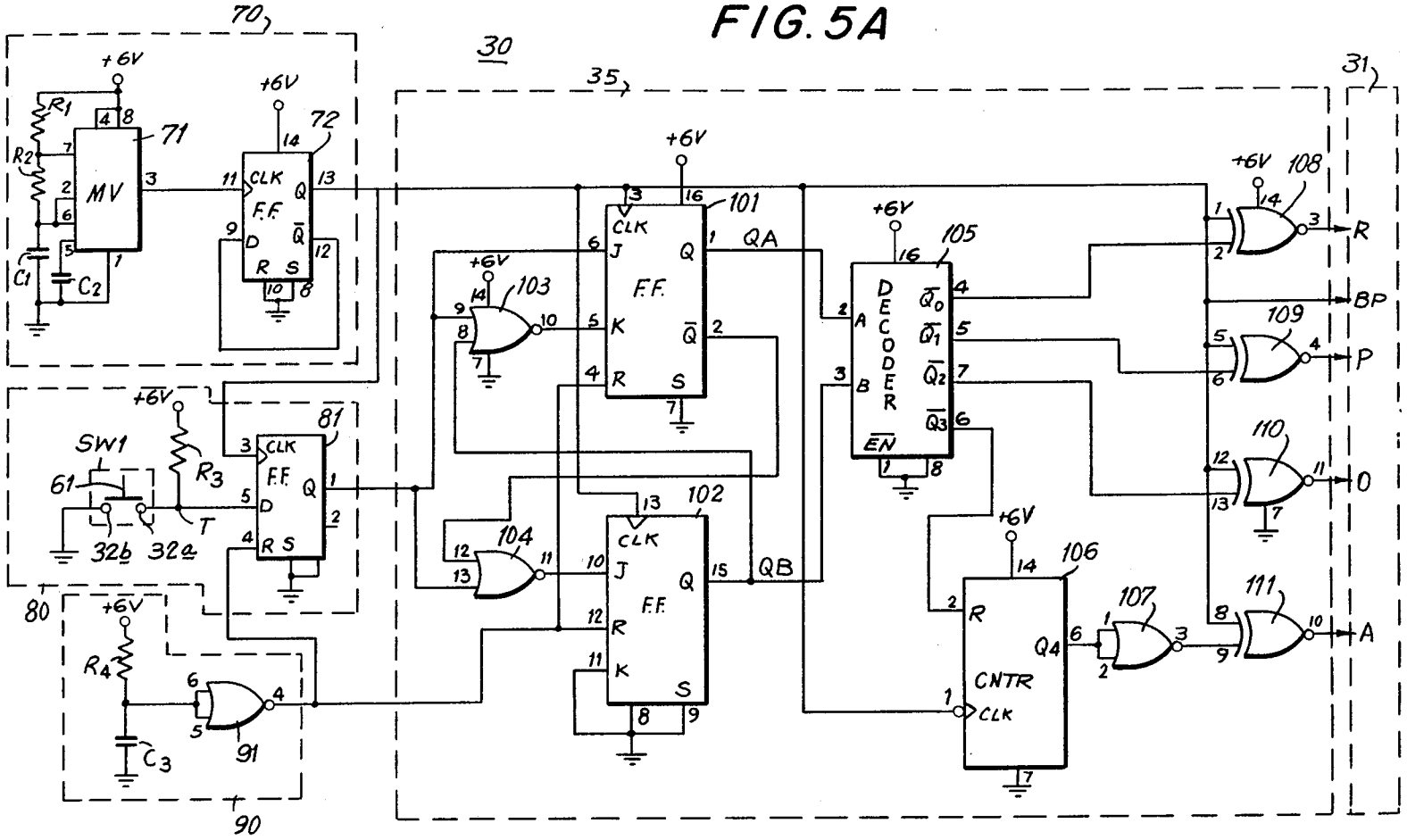
FIG. 5A is a block diagram of a preferred embodiment of the present invention and FIG. 5B is flow chart of a preferred embodiment of the present invention.

Referring now to FIG. 5A, the integrated circuits, battery 33, LCD 31 and discrete components connected to PCB 34 are shown in greater electrical detail. More particularly, device 30 comprises a clock generator circuit 70, a detecting circuit 80, reset circuit 90, logic circuit 35 and LCD 31.

Clock generator circuit 70 provides (i) the waveforms necessary for driving LCD 31, (ii) a clock signal for debouncing a switch SW1 and (iii) a clock signal for preforming logic transitions within logic circuit 35. Circuit 70 includes a multivibrator 71 (commercially available as a 555 timer), capacitors C1 and C2 (each of which has a value of 0.01 microfarads), a resistor R1 (which has a value of 1 megohm) and a resistor R2 (which has a value of 0.5 megohms). Capacitor C1 and C2 and resistors R1 and R2 are connected to multivibrator 71 to obtain the necessary time constants for producing an assymmetrical square wave of approximately 60 hertz. Pins 4 and 8 of multivibrator 71 are connected to the positive terminal of battery 33 and to one end of resistor R1. Pin 7 is connected to the other end of resistor R1 and to one end of resistor R2. Pins 2 and 6 are connected together and to the other end of resistor R2 and to one end of capacitor C1. Pin 5 is connected to one end of capacitor C2. The other ends of capacitor C1 and C2 are connected to ground, that is, the negative terminal of battery 33 and to pin 1 of multivibrator 71. Pin 3 serves as the output for multivibrator 71. Clock generator circuit 70 also includes a flip-flop 72 which is a 14 pin no. 4013 integrated circuit (i.c.) package. Only 7 pins of the 4013 i.c. package, however, are required for flip flop 72. The other 7 pins are used for a flip flop 81 which is part of signal generating circuit 80 (described below). Pin 11 of the flip flop 72, which is connected to the output of multivibrator 71, serves as the clock input for flip flop 72. The D input (pin 9) and $\overline{Q}$ (pin 12) output of flip flop 72 are connected together. Pins 8 and 10 of flip flop 72, which serve as the set(S) and reset(R) inputs, respectively, are grounded together, that is, connected to the negative terminal of battery 33. Pin 14 of flip flop 72 is connected to the positive terminal of battery 33. The output for flip flop 72 serves as the output for the entire clock generator circuit 70 and is produced at pin 13, that is, the Q output of flip flop 72.

As previously noted, multivibrator 71 provides an assymmetrical 60 hertz square wave which is unsuitable for driving LCD 31. Due to the D input and $\overline{Q}$ output of flip flop 72 being tied together, however, a high logic level output occurs at the Q output of flip flop 72 on every other positive going transition supplied to its clock input. Thus flip flop 72 acts as a divide-by-two counter. Accordingly, the output of flip flop 72 provides a symmetrical square wave suitable for driving LCD 31 and has a frequency of approximately 30 hertz.

Detecting circuit 80, which reflects whether or not cap 10 has been removed from container 50, includes contacts 32*a* and 32*b* and the electrically conductive foil 61 which hereinafter will be collectively referred to as SW 1. Circuit 80 also includes a resistor R3 which has a value of 1 meghom and a D-type flip flop 81. Contact 32*b* of SW1 is connected to ground, that is, to the negative terminal of battery 33. Contact 32*a* of SW 1 is connected to one end of resistor R3 (at node T) and to pin 5 of flip flop 81, that is, the D-input of flip flop 81. The other end of resistor R3 is connected to the positive terminal of battery 33. The clock input (pin 3) of flip flop 81 is unconnected to the output of detecting circuit 70. Pins 6 and 7 of flip flop 81 are connected to ground, that is, the negative terminal of battery 33. Pin 2 of flip flop 81 is unconnected. Pin 1 is the Q output of flip flop 81 and serves as the output for the entire detecting circuit 80. Pin 4, which serves as the reset input for flip flop 81, is connected to the output of the reset circuit 90.

Each time cap 10 is screwed on or off container 50 a number of voltage transitions occur across SW 1 representing the open and close states of SW 1 prior to SW 1 reaching a steady state electrical resistance of infinity or zero, respectively. These transitions can span over a several millisecond period. Flip flop 81 is employed as a debouncer to ensure that for each time cap 10 has been removed from or attached to container 50 the output of detecting circuit 80 reflects only one voltage transition. More specifically, every 33 milliseconds (based on the clock signal provided by clock generator 70 to flip flop 81) flip flop 81 will check the status of its D input to see whether the voltage level thereat is approximately 0 or +6 volts. The delay of 33 milliseconds is considered sufficient for substantially all voltage transitions occuring across SW 1 to have taken place. Whenever cap 10 is not securely fastened to container 50 such that SW 1 is opened, the logic level at the Q output of flip flop 81 is 1. Conversely whenever cap 10 is securely fastened to container 50, that is, whenever SW 1 is closed, the Q output of flip flop 81 will be at a logic level of 0.

Reset circuit 90 is provided to ensure that flip flop 81 of detecting circuit 80 and flip flops 101 and 102 of logic circuit 35 are reset prior to the initial closure of SW 1, that is, prior to cap 10 being securely fastened to container 50 for the first time. Circuit 90 comprises a resistor R4 having a value of 6.8 meghoms, a capacitor C3 having a value of 0.1 microfarads and a NOR gate 91 which is part of a 14 pin i.c. package, available as i.c. package no. 4001. One end of resistor R4 is connected to the positive terminal of battery 33 and the other end of resistor R4 is connected to one end of capacitor C3 and to both inputs of NOR gate 91. The other end of capacitor C3 is connected to ground, that is, to the negative terminal of battery 33. The output of NOR gate 91 is connected to the reset inputs of flip flops 81, 101 and 102. As is well known, by connecting both inputs of a NOR gate together, a NOR gate serves as an inverter. Accordingly, for approximately one RC time constant of reset circuit 90, that is, for approximately 68 milliseconds after battery 33 is initially connected to reset circuit 90, the input voltage to NOR gate 91 will have a logic level of 0 which will result in the output of reset circuit 90 having a logic level of 1. Thereafter, the voltage level across the input of NOR gate 91 will be sufficiently high so as to provide a logic level thereat of 1 resulting in the output of NOR gate 91 having a logic level of 0. Consequently, for approximately the first 68 milliseconds after battery 33 is connected to reset circuit 90 the reset inputs of flip flops 81, 101 and 102 will have a high logic level of 1 supplied thereto and thereafter will be at a low logic level of 0.

Logic circuit 35 monitors and processes the sequence of logic levels produced by detecting circuit 80 to determine whether cap 10 has ever been removed from container 50. Circuit 35 comprises flip flops 101 and 102, NOR gates 103, 104, and 107, a decoder 105, a counter 106 and exclusive NOR gates 108, 109, 110 and 111. Flip flops 101 and 102 are a dual J-K flip flop commonly referred to as a 4027 i.c. package. NOR gates 103, 104 and 107 are part of 14 pin, 4001 i.c. package which includes NOR gate 91. Decoder 105, which is a 2–4 line decoder, is available as an off-the-shelf item and is commonly identified as i.c. package no. 4556. Counter 106 is a seven-stage binary counter which is commonly identified as a 4024 i.c. package. The exclusive NOR gates 108, 109, 110 and 111 are part of a 14 pin i.c. package no. 4077.

Logic circuit 35 is electrically assembled as follows: NOR gate 103 has one input (pin 9) connected to (i) the Q output of flip flop 81, (ii) the J input of flip flop 101, and (iii) an input (pin 13) of NOR gate 104. The other input of NOR gate 103 (pin 8) is connected to the Q output of flip flip 102. Pin 14 of NOR gate 103 is connected to the positive terminal of battery 33 and pin 7 of NOR gate 103 is connected to ground, that is, the negative terminal of battery 33. The output (pin 10) of NOR gate 103 is connected to the K input of flip flop 101 at pin 5 of the latter. The clock inputs of flip flops 101 and 102 are connected to the output of clock generator 70. Pin 16 of flip flop 101 is connected to the positive terminal of battery 33 and pin 7 of flip flop 101, which is the set(S) input, is grounded, that is, connected to the negative terminal of battery 33. The reset (R) inputs of flip flops 101 and 102 (pins 4 and 12, respectively) are connected to the output of reset circuit 90. Pins 1 and 2 of flip flop 101 serve as the Q and $\overline{Q}$ outputs, respectively. The logic level at the Q output of flip flop 101 will be referred to hereinafter as $Q_A$. Input pin 12 of NOR gate 104 is connected to the $\overline{Q}$ output of flip flop 101. The output of NOR gate 104 is connected to the J input (pin 10) of flip flop 102. The K input (pin 11), set input (pin 9), and the pin 8 of flip flop 102 are connected to ground, that is, to the negative terminal of battery 33. The Q output (pin 15) of flip flop 102 produces a logic level which will hereinafter be identified as $Q_B$.

Decoder 105 is connected at its A input (pin 2) to the Q output of flip flop 101 and at its B input (pin 3) to the Q output of flip flop 102. The positive terminal of battery 33 is connected to pin 16 of decoder 105. Pins 1 and 8 of decoder 105 are grounded, that is, connected to the negative terminal of battery 33. Pins 4, 5, 6 and 7 serve as outputs $\overline{Q}_0$, $\overline{Q}_1$, $\overline{Q}_2$ and $\overline{Q}_3$, respectively.

Counter 106 is connected to the positive terminal of battery 33 at its pin 14 and is connected at its reset (R) input to $\overline{Q}_2$ of decoder 105. The clock input of counter 106 is connected to the output of clock generator 70. Pin 7 of counter 106 is grounded, that is, connected to the negative terminal of battery 33. The $Q_4$ output of counter 106 is connected to both inputs of NOR gate 107. Outputs $Q_1$, $Q_2$, $Q_3$, $Q_4$, $Q_6$, and $Q_7$ of counter 106 are left unconnected.

Pins 1, 5, 12 and 8 of exclusive NOR gates 108, 109, 110, and 111, respectively, are connected to the output of clock generator 70. Pins 2, 6, 13 and 9 of the exclusive NOR gates are connected to outputs $\overline{Q}_0$, $\overline{Q}_1$ and $\overline{Q}_3$ of decoder 105 and to the output of NOR gate 107, respectively.

Operation of device 30, as previously noted, is divided into four operating modes, namely, a reset mode, prearmed mode, armed mode and open mode. The reset mode as used herein means that flip flops 81, 101 an 102 are being reset (cap 10 has not yet been securely fastened to container 50 for the first time, that is, SW 1 has not been closed yet). The reset mode lasts for no more than the 68 millisecond period of the RC time constant produced by capacitor $C_3$ and resistor $R_4$ of reset circuit 90. Logic levels $Q_A$ and $Q_B$ during the reset mode are both at 0. Thereafter and until SW 1 is initially closed, device 30 is in the prearmed mode with logic levels $Q_A$ and $Q_B$ at 1 and 0, respectively. Once SW 1 is initially closed and until it is opened for the first time, device 30 is in the armed mode with logic levels $Q_A$ and $Q_B$ at 0 and 1, respectively. Upon SW 1 being opened and thereafter (whether or not SW 1 remains opened or is continually reclosed and reopened), device 30 is in the open mode. Logic levels $Q_A$ and $Q_B$ during the open mode are both at 1.

Upon connecting battery 33 to the circuitry shown in FIG. 5, reset circuit 90 will provide for approximately 68 milliseconds or less a high logic level of 1 to reset inputs of flip flop 81, flip flop 101 and flip flop 102. Accordingly and a previously noted, during this approximate 68 millisecond period logic levels $Q_A$ and $Q_B$ will be at 0. After this approximate 68 millisecond period, the voltage across capacitor C3 will be sufficiently high to produce a 0 logic level at the output of NOR gate 91. The reset (R) inputs of flip flops 81, 101 and 102 therefore will be at a 0 logic level and thus will be ready to monitor and process the sequential order of openings and closings of SW 1. During the prearmed mode, that is, until contacts 32*a* and 32*b* initially engage foil 61 the Q output of flip flop 81 will be at a logic level of 1 due to the D input of flip flop 81 being at approximately +6 volts. Consequently, the J and K inputs of flip flop 101 will be at logic levels of 1 and 0, respectively, resulting in the Q output ($Q_A$) and $\overline{Q}$ output of flip flop 101 having logic levels of 1 and 0, respectively. Since the output of signal generating circuit 80 is at a high level of 1 during the prearmed mode, the output of NOR gate 104 which is supplied to the J input of flip flop 102 is at a low logic level of 0. Accordingly, the Q output ($Q_B$) of flip flop 102 is at a low logic level of 0.

During the armed mode, that is, upon SW 1 closing for the first time due to cap 10 being securely fastened to container 50, the D input and thus the Q output of flip flop 81 will be at a low logic level of 0. Consequently, the J input of flip flop 101, pin 9 of NOR gate 103 and pin 13 of NOR gate 104 will be at a low logic level of 0. Additionally, since the $\overline{Q}$ output of flip flop 101 and the Q output ($Q_B$) of flip flop 102 were both at logic levels of 0 during the prearmed mode, pin 12 of NOR gate 104 and pin 8 of NOR gate 103 both will be at logic levels of 0 during the first clock pulse supplied to flip flops 101 and 102 of the armed mode. Therefore, for this first clock pulse of the armed mode NOR gate 103 will have both inputs (pins 8 and 9) at logic levels of 0 and will provide at its output to the K input of flip flop 101 a logic level of 1. Since the J input of flip flop 101 is at a 0 logic level, the Q ($Q_A$) output and $\overline{Q}$ output of flip flop 101 for the first clock pulse of the armed mode will assume logic levels of 0 and 1, respectively. Furthermore, since both inputs (pins 12 and 13) of NOR gate 104 are at logic levels of 0 for the first clock pulse of the armed mode, NOR gate 104 supplies a high logic level of 1 to the J input of flip flop 102. Thus the Q ($Q_B$) output of flip flop output will be at a high logic level of 1 for the first clock pulse during the armed mode. Still further, for all additional clock pulses during the armed mode for the J and K inputs of flip flops 101 and 102 will be at logic levels of 0. Therefore $Q_A$ and $Q_B$ will remain at 0 and 1 logic levels throughout the armed mode.

During the opened mode (SW 1 opened at least once), which begins when cap 10 is first removed from cover 50, the D input and thus the Q output of flip flop 81 are at high logic levels of 1 resulting in the J input of flip flop 101 being at a high logic level of 1. Additionally, pin 9 of NOR gate 103 and pin 13 of NOR gate 104 are at high logic levels of 1. Consequently, for all clock pulses occuring during the open mode the outputs of NOR gates 103 and 104 will be at low logic levels of 0 resulting in the K input of flip flop 101 and the J input of flip flop 102 being at low logic levels of 0. Since the J and K inputs of flip flop 101 are at logic levels of 1 and 0 for all clock pulses during the open mode, respectively, the Q output ($Q_A$) and $\overline{Q}$ output of flip flop 101 will be at logic levels of 1 and 0, respectively. The J and K inputs of flip flop 102, however, both will be at 0 logic levels for all clock pulses during the open mode since (i) NOR gate 104 continuously provides a 0 logic level to the J input and (ii) the K input is grounded. Therefore, the Q output ($Q_B$) of flip flop 102 remains at the logic level of 1 produced during the armed mode. In the event that SW 1 were to be subsequently reclosed, the J and K inputs of flip flop 101 would both be at a 0 logic level which would maintain $Q_A$ at a logic level of 1. Furthermore, in the event SW 1 were reclosed, the J and K inputs of flip flop 102 would assume logic levels of 1 and 0, respectively. Thus $Q_B$ would also remain at a logic level of 1. In other words, once cap 10 is initially disengaged from container 10, $Q_A$ and $Q_B$ both maintain logic levels of 1 no matter how many times SW 1 is reclosed or reopened. Hence $Q_A$ and $Q_B$ will sequentially, irreversibly and nonrepeatably assume logic levels of 0 and 0 (reset mode), 1 and 0 (prearmed mode), 0 and 1 (armed mode), and finally 1 and 1 (open mode), respectively.

This irreversible, nonrepeatable sequence of logic levels assumed by $Q_A$ and $Q_B$ are interpreted by decoder 105 as follows: For the reset mode ($Q_A=0$ and $Q_B=0$), the $\overline{Q}_0$ output of decoder 105 is at a logic level of 0 while the $\overline{Q}_1$, $\overline{Q}_2$ and $\overline{Q}_3$ outputs are at logic levels of 1. For the prearmed mode ($Q_A=1$ and $Q_B=0$), the $\overline{Q}_1$ output of decoder 105 is at a logic level of 0 while the $\overline{Q}_0$, $\overline{Q}_2$ and $\overline{Q}_3$ outputs are at logic levels of 1. For the armed mode, ($Q_A=0$ and $Q_B=1$), the $\overline{Q}_2$ output of decoder 105 is at a logic level of 0 while the $\overline{Q}_0$, $\overline{Q}_1$ and $\overline{Q}_3$ outputs of decoder 105 are at logic levels of 1. Finally, for the opened mode ($Q_A=1$ and $Q_B=1$), the $\overline{Q}_3$ output of decoder 105 is at a logic level of 0 while the $\overline{Q}_0$, $\overline{Q}_1$ and $\overline{Q}_2$ outputs of decoder 105 are at logic levels of 1.

As is well known in the art, an LCD includes a back plane and a front plane. The front plane has one or more segments, each segment forming a particular message. In order for a message to appear on an LCD, a continuous, alternating voltage difference of at least a predetermined magnitude must be applied between the back plane and the desired segment. Those segments whose voltage difference relative to the back plane are not at or above the predetermined magnitude will not be visible. The front plane of display 31 comprises various segments in the form of messages and/or symbols which indicate whether device 30 is in a reset mode, prearmed mode armed mode or open mode and which are represented in FIG. 5 by the letters R, P, A and O, respectively. The letters BP shown within LCD 31 of FIG. 5 represent the back plane. As previously noted in order for the desired segment to be visible, a continuous and alternating voltage difference of a predetermined magnitude or greater must be present between the back plane and desired segment on the front plane of LCD 31. This is accomplished by supplying the clock signal from clock generator circuit 70 to the back plane (BP) and supplying an inverted clock signal to the desired segment (P, A, R, or O) of the front plane. More specifically, whenever one of the inputs of one of the four exclusive NOR gates is at a logic level of 0, the signal provided to the other input of that exclusive NOR gate becomes inverted at its output. In contrast thereto, whenever one of the inputs of one of the four exclusive NOR gates is at a logic level of 1, the signal provided to the other input of that exclusive NOR gate is reproduced at its output. Thus, in order to supply an inverted clock signal at the desired segment, the clock signal is provided as one input to each of the exclusive NOR gates (108, 109, 110, 111) while the other input at the particular exclusive NOR gate at which the clock signal is to be inverted is at a logic level of 0. As can now be readily appreciated, the reset (R) segment will be visible during the reset mode, when $\overline{Q}_0$ is at a logic level of 0 so that an inverted clock signal is produced at the output of exclusive NOR gate 108 and supplied to the reset (R) segment. Furthermore, during the reset mode the other exclusive NOR gates 109, 110 and 111 will produce noninverted clock signals at their outputs due to their input pins 6, 9 and 13 being at logic levels of 1. Consequently, no other segments will be visible since the back plane (BP) and these other segments (P, A, and O) are at the same voltage potential at all times.

Similarly, during the prearmed (P), armed (A), or open (O) modes only one of the other decoder 105 outputs, namely, the $\overline{Q}_1$, $\overline{Q}_2$ or $\overline{Q}_3$ outputs will be at a logic level of 0, respectively, while the other ouptuts of decoder 105 are at a logic level of 1. Consequently, only the prearmed (P) segment will be visible during the prearmed mode, only the armed (A) segment will be visible (as further explained below) during the armed mode and only the open (O) segment will be visible during the open mode.

Counter 106 operates as follows: During the reset (R), prearmed (P) and open (O) modes, the $\overline{Q}_2$ output of decoder 105 provides a logic level of 1 to the reset input of counter 106. Thus the $Q_5$ output of counter 106 supplies a 0 logic level to NOR gate 107 resulting in a logic level of 1 provided to pin 9 of exclusive NOR gate 111. During the armed mode, however, the $\overline{Q}_2$ output of decoder 105 provides a logic level of 0 to the reset input of counter 106. Thus each time a trailing edge of a clock pulse is received at the clock input of counter 106, the value of the count is incremented by 1. Once the count reaches a value of 16, $Q_5$ will switch from a logic level of 0 to a logic level of 1. Pin 9 of exclusive NOR gate 111 will then switch from a logic level of 1 to 0. Since an inverted clock signal now will be supplied to the armed (A) segment, the armed (A) segment (such as seen in FIG. 1) becomes visible. When the value of the count reaches 32, the $Q_5$ output will once again assume a logic level of 0 and will remain thereat until the value of the count reaches 48 at which time the $Q_5$ output will again assume a logic level of 1. In ther words, the logic level of the $Q_5$ output will continually flip flop between 0 and 1 every 16 counts, that is, every 16 pulses. Thus, the voltage applied to the armed (A) segment of LCD 31 will be in phase with and at the same magnitude as the back plane (BP) for 16 clock pulses and then 180° out of phase (inverted) with the back plane (BP) for the next 16 clock pulses. Therefore, the armed (A) segment will appear to flash on and off. In this way, attention is drawn to the fact that the contents of the container is safe to use. Additionally, and as previously noted, the absence of a flashing armed message alerts a user that a wrongdoer has tampered with the contents of container 50. Of course, if desired, a flashing message can be made to occur during the open mode rather than the armed mode. In this instance, (i) the reset input of counter 106 is connected to output $\overline{Q}_3$ of decoder 105, (ii) pin 13 of exclusive NOR gate 110 is connected to the output (pin 3) of NOR gate 107 and (iii) $\overline{Q}_2$output of decoder 105 is connected to pin 9 of exclusive NOR gate 111.

Figure 5B:
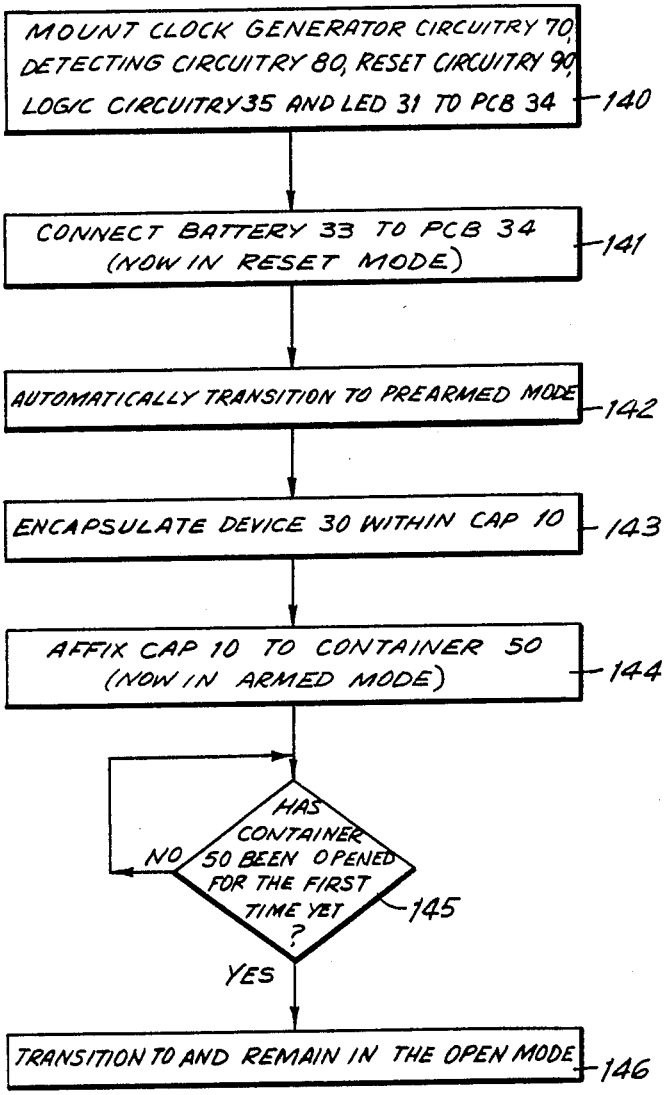

The foregoing description of the physical assembly and operation of device 30 is summarized in chronological order by the flow chart of FIG. 5B. Initially, under step 140 the circuitry comprising clock generator circuit 70, detecting circuit 80, reset circuit 90 and logic circuit 35 as well as LCD 31 is connected to PCB 34. Next, under step 141, battery 33 is mounted to PCB 34 so as to connect battery 33 to circuits 35, 70, 80 and 90 and LCD 31. Upon connecting battery 33 to PCB 34, device 30 will be in the reset mode and will display the letter R on LCD 31. Approximately 68 milliseconds after entering the reset mode, device 30 will automatically transition to step 142, that is, to the prearmed mode and will display the letter P on LCD 31. Under step 143 during which time device 30 remains in the prearmed mode encapsulation by epoxy of device 30's components takes place. Cap 10 is then affixed to container 50 under step 144 and thus transitions device 30 to the armed mode. Device 30 will now display the armed message of the smiling face and "OK" message on LCD 31. Under step 145, logic circuit 35 continuously monitors detecting circuit 80 to determine when container 50 has been opened for the first time. Meanwhile, device 30 remains in the armed mode, that is, LCD 31 flashes the smiling face and "OK" message on and off. Once container 50 has been opened for the first time device 30 transitions to and remains thereafter in the opened mode. During the opened mode, LCD 31 displays an unhappy face and the word "Tampered" or other similar warning.

Figure 6:
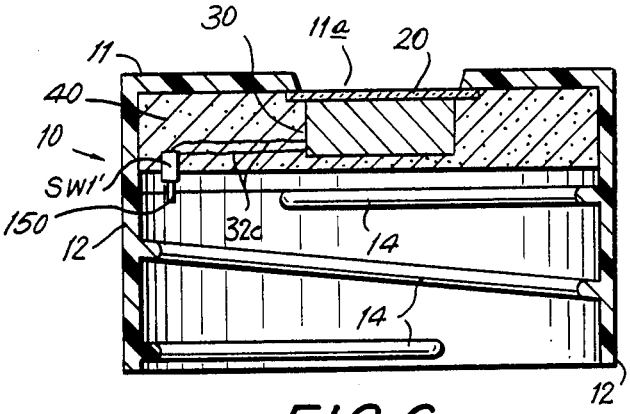
FIG. 6 is a cross sectional view of a cap similar to FIG. 2A illustrating an alternate embodiment of the present invention.

In an alternate embodiment as shown in FIG. 6, SW 1 is replaced with a switch SW 1' (commonly referred to as a microswitch) which is within cap 10 having an actuator 150 protruding from potting material 40. Seal 60 and foil 61 also are no longer required. Depression of actuator 150 closes SW 1' so as to electrically provide a short circuit from node T to ground of detecting circuit 80. Such depression occurs by actuator 150 coming into contact with rim 53 whenever cap 10 is securely fastened to container 50. Contrastingly, upon actuator 150 being released from its depressed state SW 1' opens so as to electrically provide an open circuit between node T and ground of detecting circuit 80. Such release occurs whenever cap 10 is removed from container 50.

Figure 7A:
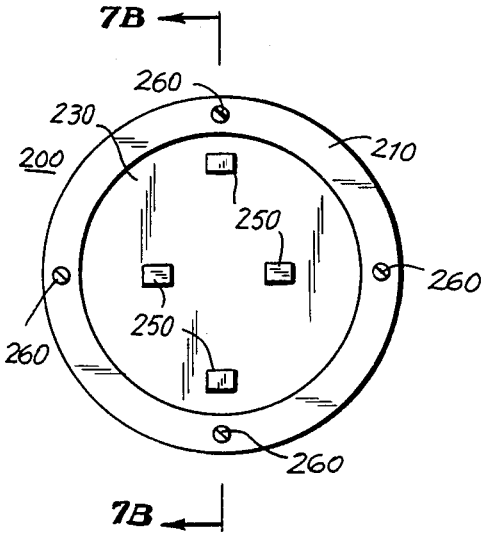
FIG. 7A is a top plan view of a pressure transducer device and FIG. 7B is a cross sectional view of the transducer taken along the lines 7B—7B in FIG. 7A.
Figure 7B:
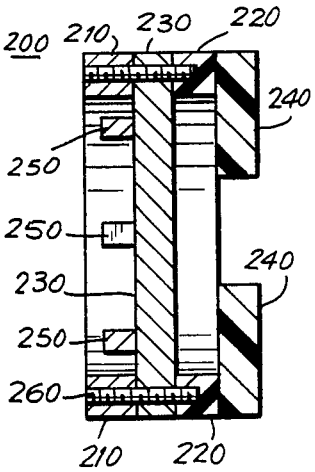
Figure 8:
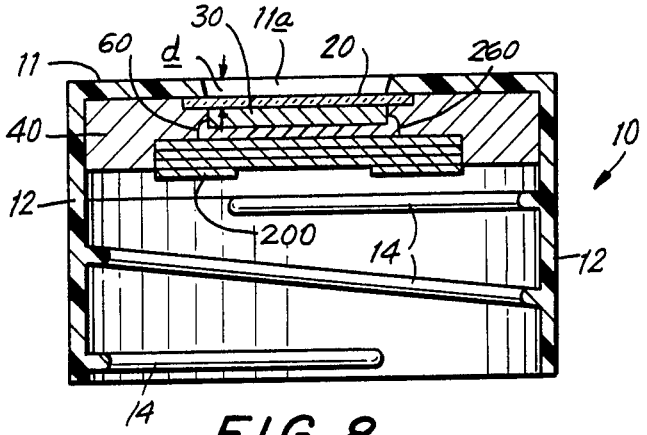
FIG. 8 is a cross sectional view of a cap similar to FIG. 2A illustrating another embodiment of the present invention.

In another embodiment of the present invention, the pressure within the container 50 is sensed in order to determine whether cap 10 has been removed. More particularly, in this alternative embodiment the pressure within container 50 is at less than atmospheric pressure prior to cap 10 being removed from container 50 for the first time. Switch SW 1 and seal 60 and foil 61 are no longer required. Rather, as shown in FIGS. 7 and 8 a pressure transducer 200 available from Omega Engineering Inc. of Stamford, Conn. As PX-102-006GV is used to sense whether cap 10 has been removed from container 50. Pressure transducer 200, comprises an outer O-shaped, plastic ring 210; an inner O-shaped, plastic ring 220; a diaphragm 230; a plastic support block 240, strain gages 250 and screws 260. Diaphragm 230 is sandwiched between rings 210 and 220. Screws 260 holds this sandwich together. Support block 240, which is adhesively bonded to inner ring 220, provides rigidity to limit the movement of the diphragm 230. Strain gages 250 are bonded onto diaphragm 230. Wires 260 connect strain gages 260 to PCB 34.

Figure 9:
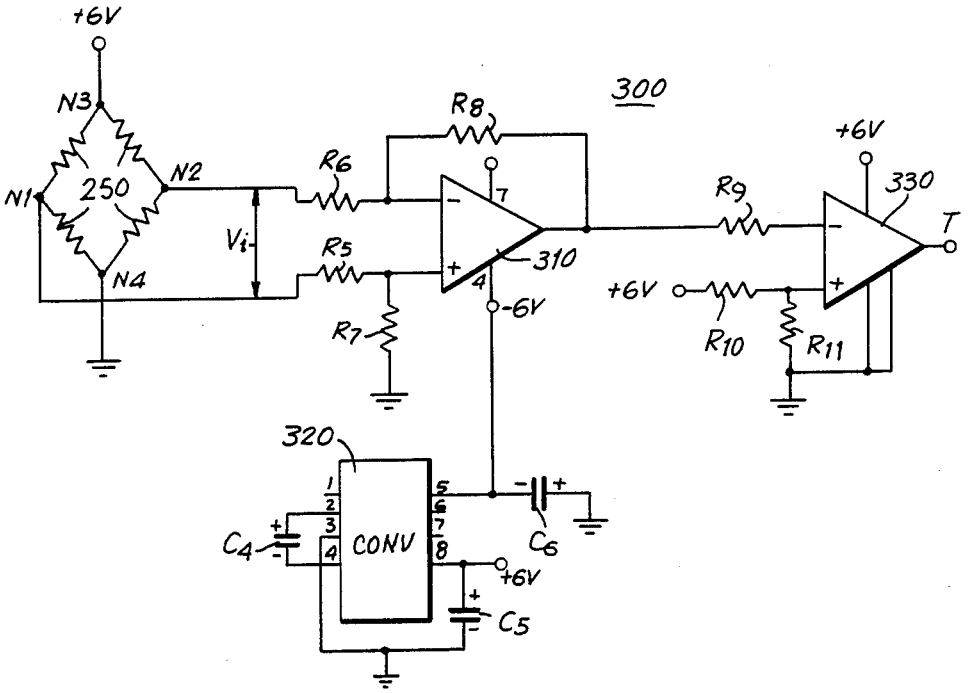
FIG. 9 is an electrical schematical diagram incorporating the pressure transducer within the present invention.

Referring now to FIG. 9 the pressure transducer circuitry 300 is electrically connected together as follows: The four strain gages 250 from a bridge type circuit between nodes N1, N2, N3 and N4 with the positive terminal of battery 33 connected to two of the strain gages at node N3 and the negative terminal of the battery connected to the other two strain gages at node N4. A voltage Vi is provided between nodes N1 and N2. Connected to nodes N1 and N2 are resistors R5 and R6, respectively. Resistors R5 and R6 each have a resistance of 10,000 ohms. Connected to resistors R5 and R6 are the noninverting and inverting inputs of an operational amplifier 310, respectively. Amplifier 310 is available as an off the shelf item commonly identified as OP02. Connected between resistor R5 and the noninverting input of amplifier 310 is a resistor R7 which is connected at its other end to the negative terminal of battery 33 and which has a value of 200,000 ohms. A resistor R8, having a resistance of 200,000 ohms, is connected between the output and inverting input of amplifier 310. Amplifier 310 is connected at its pin 7 to the positive terminal of battery 33. A voltage of −6 volts is provided to pin 4 of amplifier 310 by a converter 320.

Converter 320 is an 8 pin i.c. available from Intersil Inc. of Cupertino, Calif. as part no. ICL 7660. Connected between inputs 2 and 4 of converter 320 is an electrolytic capacitor C4 having a value of 10 microfarads wherein the positive end of C4 is connected to pin 2. Between inputs 3 and 8 of converter 320 is an electrolytic capacitor C5 having a value of 1 microfarad wherein the positive end of capacitor C5 is connected to pin 8. Pins 8 and 3 are also connected to the positive and negative terminals of battery 33, respectively. A 10 microfarad electrolytic capacitor C6 is connected at its positive end to ground (i.e. negative terminal of battery 33) and at its negative end to pin 5 of converter 320. Pin 5 provides the −6 volt potential required by amplifier 310.

The output of amplifier 310 is connected to the inverting input of a comparator 330 through a resistor R9 which has a resistance of 10,000 ohms. Comparator 330 is commonly available as part no. CMP02. Connected to the noninverting input of comparator 330 is one end of a resistor R10 having a value of 156,000 ohms and one end of a resistor R11 having a value of 10,000 ohms. Connected to the other end of resistor R10 is the positive terminal of battery 33. Resistor R11 is connected at its other end to ground (i.e. the negative terminal of battery 33). Pins 1 and 4 of comparator 330 are also grounded. The output of comparator 330 is connected to node T of signal generating circuit 80.

In operation, the pressure exerted on diaphragm 230 produces the output voltage (Vi) which is proportional to the pressure differential between the ambient atmospheric pressure and the pressure exerted on the diaphragm 230 of transducer 200. Voltage Vi is zero volts when the pressure exerted on diaphragm 230 is at atmospheric pressure and increases typically at a linear rate as the pressure exerted on diaphragm 230 decreases.

Voltage Vi is multiplied by the gain of amplifier 310 which produces a single ended voltage suitable for comparison by comparator 320. Whenever the voltage applied to the inverting input is equal to or less than the voltage applied to the noninverting input of comparator 330, the voltage at node T will be +6 volts. Whenever the voltage applied to the inverting input is greater than the voltage applied to the noninverting input of comparator 330, the voltage at node T will be 0 volts. Prior to cap 10 being removed from container 50 for the first time, the pressure within the container 50 will be below a threshold value so that the voltage at node T is at zero volts. When the pressure within container 50 reaches or exceeds this threshold value, the voltage at node T will be at +6 volts.

Thus each of the aforementioned embodiments (employing SW 1,SW 1' or the pressure transducer) provides a voltage of 0 at the D input of flip flop 81 when cap 10 is initially, fully secured to container 50 and a voltage of +6 volts at the D input of flip flop 81 when cap 10 is removed from container 50.

As now can be readily appreciated, the present invention provides a new and improved device which indicates whether or not cap 10 has ever been removed from the container 50. In particular, the present invention provides a tamper proof device by producing a plurality of logic levels in response to the initial engagement of cap 10 to container 50 and subsequent disengagement therefrom which are in an irreversible and nonrepeatable sequence. The present invention because it employs readily available, off the shelf components also is inexpensive to manufacture. Furthermore, the present invention may be customized so as to fit within a small cap. Still further, the present invention is extremely simple to assemble.

The present invention also can be manufactured so that most or all of the components of device 30 are disposed on or within container 50. For example, container 50 can have a hollow base which houses all of the components of device 30 except for LCD 31, switch SW 1, and wires 32*c*. Additionally, LCD 31 need not necessarily be within cap 10. Instead LCD 31 can be positioned on or within container 50. In this regard, a hollowed portion of container 50 could be used to house LCD 31 and connect the same to PCB 34.

Having specifically described illustrative embodiments of the invention with reference to the accompanying drawings, it is to be understood that the invention is not limited to these precise embodiments and that various changes and modifications may be effected therein by one skilled in the art without departing from the scope and spirit of the invention as defined in the appended claims.

We claim:

1. A tamper indicating closure for a container, said closure including an upper wall, a peripheral wall and means for securing said closure to said container, the improvement comprising a display window in one of said walls, electronically controlled display means within said closure and adjacent said display window for displaying a signal visible through said display window indicating whether the closure has been opened, a source of electric power, electric circuit means for controlling said display means, said source and electric circuit means being physically retained within said closure and in an electric circuit with said display means, and detecting means within said closure for detecting engagement of said closure and container and for producing an electrical signal depending on such engagement, said electric circuit means being responsive to said detecting means for determining the signal to be displayed by said display means.

2. A tamper indicating closure according to claim 1, wherein said detecting means comprises means for arming said electric circuit means upon initial engagement of said closure and container, said electric circuit means being responsive to said initial engagement for causing an untampered state to be indicated by said display means until said closure and container are disengaged.

3. A tamper indicating closure according to claim 2, wherein said electric circuit means causes said display means to produce a permanent tampered display signal in response to the first disengagement of said closure and container.

4. A tamper indicating closure according to claim 3, wherein said detecting means comprises switch means.

5. A tamper indicating closure according to claim 4, wherein portions of said switch means are disposed on said closure and on said container.

6. A tamper indicating closure according to claim 3, wherein said detecting means comprises pressure transducer means within said closure responsive to the air pressure within said container.

7. A tamper indicating closure according to claim 3, wherein said electric circuit means includes means for producing a flashing untampered display signal.

8. A tamper indicating closure according to claims 1 or 3, wherein said display means comprises a liquid crystal display, and said source of electric power and electric circuit means are concealed beneath the upper wall of said closure by a potting material.

9. A tamper indicating closure according to claim 8 wherein said power source comprises a battery.

10. In combination, a tamper indicating closure and container, said closure including an upper wall, a peripheral wall and means for securing said closure to said container, the improvement comprising a display window in one of said walls, electronically controlled display means within said closure and adjacent said display window for displaying a signal visible through said display window indicating whether the closure has been opened, a source of electric power, electric circuit means for controlling said display means, said source and electric circuit means being physically retained within said closure and in an electric circuit with said display means, and detecting means within said closure for detecting engagement of said closure and container for producing an electrical signal depending on such engagement, said electric circuit means being responsive to said detecting means for determining the signal to be displayed by said display means.

11. The combination of a closure and container according to claim 10, wherein said detecting means comprises means for arming said electric circuit means upon initial engagement of said closure and container, said electric circuit means being responsive to said initial engagement for causing an untampered state to be indicated by said display means until said closure and container are disengaged.

12. The combination of a closure and container according to claim 11, wherein said electric container means causes said display means to produce a permanent tampered display signal in response to the first disengagement of said closure and container.

13. The combination of a closure and container according to claim 12, wherein said detecting means comprises switch means.

14. The combination of a closure and container according to claim 13, wherein portions of said switch means are disposed on said closure and on said container.

15. The combination of a closure and container according to claim 12, wherein said detecting means comprises pressure transducer means within said closure responsive to the air pressure within said container.

16. The combination of a closure and container according to claim 12, wherein said electric circuit means includes means for producing a flashing untampered display signal.

17. The combination of a closure and container according to claim 10 or 12, wherein said display means comprises a liquid crystal display, and said source or electric power and electric power means are concealed beneath the upper wall of said closure by a potting material.

18. The combination of a closure and container according to claim 17, wherein said power source comprises a battery.

* * * * *